US008082928B2

(12) United States Patent
Gueret

(10) Patent No.: US 8,082,928 B2
(45) Date of Patent: Dec. 27, 2011

(54) BRUSH FOR APPLYING PRODUCT TO KERATINOUS FIBERS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 78 days.

(21) Appl. No.: 12/429,142

(22) Filed: Apr. 23, 2009

(65) Prior Publication Data

US 2009/0199862 A1 Aug. 13, 2009

Related U.S. Application Data

(63) Continuation of application No. 10/084,975, filed on Mar. 1, 2002, now abandoned.

(30) Foreign Application Priority Data

Mar. 1, 2001 (FR) ..... 01 02800

(51) Int. Cl.
*A45D 40/26* (2006.01)

(52) U.S. Cl. ..... 132/218

(58) Field of Classification Search ..... 132/218, 132/317, 320; 401/122, 129; 15/160
See application file for complete search history.

(56) References Cited

U.S. PATENT DOCUMENTS

| | | | |
|---|---|---|---|
| 565,328 | A | 8/1896 | Buhler |
| 1,659,707 | A | 2/1928 | Rudolph et al. |
| 1,806,520 | A | 5/1931 | Cave |
| 1,962,854 | A | 6/1934 | Anderson |
| 2,448,603 | A | 9/1948 | Kevin et al. |
| 3,033,213 | A | 5/1962 | Joss et al. |
| 3,214,782 | A | 11/1965 | Masters et al. |
| 3,469,928 | A | 9/1969 | Widegren |
| 3,908,675 | A | 9/1975 | Spatz et al. |
| 3,908,676 | A | 9/1975 | Levine et al. |
| 3,921,650 | A | 11/1975 | Montgomery |
| 4,365,642 | A | 12/1982 | Costa |

(Continued)

FOREIGN PATENT DOCUMENTS

DE 42 05 935 9/1993

(Continued)

OTHER PUBLICATIONS

English language Derwent Abstract of DE 42 05 935, Sep. 2, 1993.

(Continued)

*Primary Examiner* — Robyn Doan
(74) *Attorney, Agent, or Firm* — Finnegan, Henderson, Farabow, Garrett & Dunner, LLP

(57) ABSTRACT

A device for applying a product to keratinous fibers may comprise a stem having two opposite ends and a brush portion connected to one end portion of the stem. The one end portion of the stem may have a longitudinal axis and the brush portion may have a free end that is not aligned with the longitudinal axis of the one end portion of the stem. The brush portion may comprise a core and at least part of the core may be curved such that a line tangent to the core at any axial position along the core is not perpendicular to the longitudinal axis of the one end portion of the stem. The brush portion may further comprise bristles connected to the core. The bristles may comprise ends defining an envelope surface having a varying cross-section along at least a part of its length. The envelope surface may be asymmetrical about a midplane of the envelope surface, the midplane being oriented perpendicular to the core.

19 Claims, 9 Drawing Sheets

U.S. PATENT DOCUMENTS

| | | | |
|---|---|---|---|
| 4,403,624 | A | 9/1983 | Montgomery |
| 4,458,701 | A | 7/1984 | Holland |
| 4,461,312 | A | 7/1984 | Gueret |
| 4,527,575 | A | 7/1985 | Vasas |
| 4,545,393 | A | 10/1985 | Gueret et al. |
| 4,561,456 | A | 12/1985 | Gueret |
| 4,586,520 | A | 5/1986 | Brittain |
| 4,635,659 | A | 1/1987 | Spatz |
| 4,662,385 | A | 5/1987 | Schefer |
| 4,784,505 | A | 11/1988 | Dahm |
| 4,804,004 | A | 2/1989 | Taylor |
| 4,810,122 | A | 3/1989 | Cole |
| 4,887,622 | A | 12/1989 | Gueret |
| 4,898,193 | A | 2/1990 | Gueret |
| 4,921,366 | A | 5/1990 | Hurrell |
| 4,927,281 | A | 5/1990 | Gueret |
| 4,993,440 | A | 2/1991 | Gueret |
| 5,094,254 | A | 3/1992 | Krueckel et al. |
| 5,137,038 | A | 8/1992 | Kingsford |
| 5,176,156 | A | 1/1993 | Ashtary et al. |
| 5,197,497 | A | 3/1993 | Gueret |
| 5,224,787 | A | 7/1993 | Vasas |
| 5,238,011 | A | 8/1993 | Gueret |
| 5,309,929 | A | 5/1994 | Toll |
| 5,339,841 | A | 8/1994 | Gueret |
| 5,345,644 | A | 9/1994 | Gueret |
| 5,357,987 | A | 10/1994 | Schrepf |
| 5,418,999 | A | 5/1995 | Smith |
| 5,482,059 | A | 1/1996 | Miraglia |
| 5,542,439 | A | 8/1996 | Gueret |
| 5,551,456 | A | 9/1996 | Hartel |
| 5,595,198 | A | 1/1997 | Kemmerer |
| 5,613,258 | A | 3/1997 | Hilfinger et al. |
| 5,709,230 | A | 1/1998 | Miraglia |
| 5,722,436 | A | 3/1998 | Vandromme et al. |
| 5,803,638 | A | 9/1998 | Gueret |
| 5,853,011 | A | 12/1998 | Gueret |
| 5,860,432 | A | 1/1999 | Gueret |
| 5,862,812 | A | 1/1999 | Dumler |
| 5,876,138 | A | 3/1999 | Gueret |
| 5,894,847 | A | 4/1999 | Gueret |
| 5,918,994 | A | 7/1999 | Gueret |
| 5,934,292 | A | 8/1999 | Gueret |
| 5,937,870 | A | 8/1999 | Gueret |
| 6,003,519 | A | 12/1999 | Gueret |
| 6,067,997 | A | 5/2000 | Gueret |
| 6,076,531 | A | 6/2000 | Gueret |
| 6,076,985 | A | 6/2000 | Gueret |
| 6,099,183 | A | 8/2000 | Gueret |
| 6,220,254 | B1 | 4/2001 | Gueret |
| 6,237,609 | B1 | 5/2001 | Vasas |
| 6,341,913 | B1 | 1/2002 | Wilson-Jackson |
| 6,345,923 | B2 | 2/2002 | Gueret |
| 6,494,215 | B2 | 12/2002 | Gueret |
| 6,508,603 | B1 | 1/2003 | Vasas |
| RE38,019 | E | 3/2003 | Gueret |
| 6,532,967 | B1 * | 3/2003 | Dumler ..... 132/218 |
| RE38,230 | E | 8/2003 | Gueret |
| 6,662,810 | B2 | 12/2003 | Gueret |
| RE38,397 | E | 1/2004 | Gueret |
| 7,171,969 | B2 | 2/2007 | Gueret |

FOREIGN PATENT DOCUMENTS

| | | |
|---|---|---|
| EP | 0 511 842 | 11/1992 |
| EP | 0 663 161 | 7/1995 |
| EP | 1 020 136 | 7/2000 |
| FR | 726 157 | 5/1932 |
| FR | 2 285 101 | 4/1976 |
| FR | 2 505 633 | 11/1982 |
| FR | 2 605 505 | 4/1988 |
| FR | 2 678 494 | 1/1993 |
| FR | 2 701 198 | 8/1994 |
| FR | 2 715 038 | 7/1995 |
| FR | 2 730 910 | 8/1996 |
| FR | 2 730 911 | 8/1996 |
| FR | 2 745 272 | 8/1997 |
| FR | 2 749 489 | 12/1997 |
| FR | 2 749 490 | 12/1997 |
| FR | 2 755 593 | 5/1998 |
| FR | 2 798 267 | 3/2001 |
| FR | 2 811 525 | 1/2002 |
| GB | 1 335 322 | 10/1973 |
| GB | 2 146 520 | 4/1985 |
| GB | 2 170 996 | 8/1986 |
| GB | 2 174 895 | 11/1986 |
| JP | 56-91507 U | 12/1954 |
| JP | 55-136409 | 9/1980 |
| JP | 58-88912 U | 6/1983 |
| JP | 63-111808 | 5/1988 |
| JP | 5-88410 U | 12/1993 |
| JP | 6-237818 | 8/1994 |
| JP | 8-33518 | 2/1996 |
| JP | 11-222274 | 8/1999 |
| WO | WO 93/16617 | 9/1993 |
| WO | WO 96/29905 | 10/1996 |

OTHER PUBLICATIONS

English language translation of FR 726 157.
English language Derwent Abstract of FR 2 285 101, Apr. 16, 1976.
English language Derwent Abstract of FR 2 678 494, Jan. 8, 1993.
English language Derwent Abstract of FR 2 798 267, Mar. 16, 2001.
English Language Derwent Abstract of EP 1 020 136, Jul. 19, 2000.

* cited by examiner

BRUSH FOR APPLYING PRODUCT TO KERATINOUS FIBERS

This is a continuation of application Ser. No. 10/084,975, filed Mar. 1, 2002 now abandoned, which is incorporated herein by reference.

The present invention relates to an applicator for applying a product, such as a cosmetic or a care product, for example, to keratinous fibers. In particular, the invention relates to an applicator for applying mascara to the eyelashes. The invention also relates to a device including such an applicator.

Numerous applicator brushes are known that are formed by helically twisting two branches of a metal wire so as to hold bristles extending radially from the twisted wire. The branches may be fixed in a stem made of plastic material, for example, and secured to a cap for closing a container containing the product to be applied with the brush. The free ends of the bristles may define an envelope surface, which may define numerous of shapes.

It may be desirable to further improve existing brushes and to improve the quality of the makeup obtained therewith, for example, in terms of product takeup, and/or eyelash elongation, and/or eyelash curling, and/or penetration of bristles, for example, between the eyelashes, and/or separation of the eyelashes.

It should be understood that the invention could be practiced without performing one or more of the aspects described herein. Certain aspects will become apparent from the detailed description which follows. As embodied and broadly described herein, the invention includes a device for applying a product to keratinous fibers comprising a stem having two opposite ends and a brush portion connected to one end portion of the stem. The one end portion of the stem may have a longitudinal axis and the brush portion may have a free end that is not aligned with the longitudinal axis of the one end portion of the stem. The brush portion comprises a core and at least part of the core may be curved such that a line tangent to the core at any axial position along the core is not perpendicular to the longitudinal axis of the one end portion of the stem. The brush portion may further comprise bristles connected to the core. The bristles may comprise ends defining an envelope surface having a varying cross-section along at least a part of its length. The envelope surface may be asymmetrical about a midplane of the envelope surface, and the midplane may be oriented perpendicular to the core.

As used herein, the term "cross-section" relates to a cross-section taken in a plane perpendicular to the axis of the core. The term "envelope surface" as used herein refers to an imaginary surface defined by ends of at least some of the bristles extending from the core of the applicator brush portion or blank. For example, the envelope surface could be considered to be the three dimensional image seemingly formed by the bristle ends when the applicator/blank is viewed by an observer. When there are a mixture of shorter bristles and longer bristles extending in substantially the same direction at substantially the same axial position on the core, the ends of the longer bristles may define the envelope surface, while the ends of the shorter bristles may be beneath that surface.

The brush portion may be formed from a blank comprising a blank core and blank bristles having ends defining a blank envelope surface. The blank envelope surface may be asymmetrical about a midplane of the blank envelope surface oriented perpendicular to the blank core.

As used herein, the term "blank" refers to a partially-manufactured applicator or a partially manufactured part of an applicator, such as the brush portion, for example, that may be subjected to one or more additional manufacturing steps before becoming a completed applicator. For example, the term "blank" may be used herein to refer to an applicator that has a core that has not yet been curved.

An edge portion may partially define the blank envelope surface and may be nonrectilinear when observed in profile in a direction perpendicular to the blank core. The edge portion may become at least partially straightened by curving at least the part of the blank core.

The envelope surface may have at least one extreme cross-section chosen from a maximum cross-section and a minimum cross-section located axially between axial ends of the envelope surface. The brush portion may have a maximum cross-section located axially between axial ends of the envelope surface. The envelope surface may have a minimum cross-section located axially between axial ends of the envelope surface. As an alternative, the brush portion may have a maximum cross-section and a minimum cross-section located axially between axial ends of the envelope surface.

According to an exemplary embodiment, the nonrectilinear edge potion may be located in one of a first third and a last third of the length of the blank envelope surface. The nonrectilinear edge portion may be outwardly concave.

According to another exemplary embodiment, the nonrectilinear edge portion may be located in the last third of the length of the blank envelope surface, as measured in a direction facing away from a free end of the blank.

The nonrectilinear edge portion may be outwardly convex. The nonrectilinear edge portion may be located in the first third of the length of the blank envelope surface, as measured in a direction facing away from a free end of the blank.

In yet another exemplary embodiment, the nonrectilinear edge portion may be defined at least in part by a substantially bullet-shaped part of the blank envelope surface. The bullet-shaped part may comprise a free end of the blank, and a cross-section of a remainder of the blank envelope surface may taper over at least a part of the length of the blank envelope surface in a direction from the bullet-shaped part toward an end of the blank opposite the free end of the blank.

The nonrectilinear edge portion further may be defined by an intersection of a frustoconical-shaped zone of the blank and a frustoconical-shaped body portion of the blank, with the frustoconical-shaped zone being proximate a free end of the blank and converging toward the free end of the blank, and the frustoconical-shaped body portion extending from the intersection and converging toward an end of the blank opposite the free end of the blank.

The blank envelope surface may have a fish-like shape, and the nonrectilinear edge portion may be defined by a zone proximate a junction between an end portion of the blank envelope surface opposite a free end of the blank and a remainder of the blank envelope surface. The end portion may form a tail of the fish-like shape.

The blank envelope surface may have an hourglass-like shape, and the nonrectilinear edge portion may be defined by a reentrant angle at a junction between two truncated cone shapes forming the hourglass-like shape.

According to yet another exemplary embodiment, the blank envelope surface may define a football-like shape having at least one cut-out. The nonrectilinear edge portion may be one of defined by the cut-out and lie in a vicinity of an end of the cut-out. The cut-out may be chosen from a notch and a facet.

In yet another exemplary embodiment, the nonrectilinear edge portion may be deformed by curving at least part of the blank core so as to cause at least part of the nonrectilinear edge portion to lie substantially on an axis of an edge of a remainder of the blank envelope surface adjacent the nonrectilinear edge portion.

The brush portion may be formed from a blank comprising a blank core and blank bristles comprising ends defining a blank envelope surface and the blank envelope surface may be substantially circularly symmetrical.

As used herein, the term "circularly symmetrical" refers to a configuration having a circular shaped cross-section, wherein the axis of the core passes through the center of the circular shaped cross-section.

In an exemplary embodiment, the brush portion may be formed from a blank comprising a blank core and blank bristles comprising ends defining a blank envelope surface. The blank envelope surface may be substantially axially symmetrical about a longitudinal axis of the core.

The brush portion may be formed from a blank having a blank core curved about at least one axis disposed outside the midplane of the blank.

In an exemplary embodiment, the core may comprise a twisted wire core. The twisted wire core may have a left-hand pitch or a right-hand pitch. The bristles may be held between wires of the twisted wire core. In yet another exemplary embodiment, the twisted wire core may have a left-hand pitch and at least part of the core may be curved so as to decrease an inclination of helical turns formed by free ends of the bristles relative to the longitudinal axis of the end portion of the stem in a direction facing away from the stem. This may make it possible to improve the separation of eyelashes at the ends of an eyelid, by increasing the angle between the eyelashes and said sheets.

According to another exemplary embodiment, the bristles comprise bristles of differing lengths. The bristles may comprise longer bristles defining the envelope surface of the brush portion and shorter bristles contained within a space defined by the envelope surface.

Yet another exemplary embodiment includes a brush portion formed from a blank comprising a blank core and blank bristles having ends defining a blank envelope surface. The blank envelope surface may have at least one substantially planar facet formed thereon. The at least one substantially planar facet may comprise three substantially planar facets and the blank envelope surface may have a cross-section that is substantially triangular in shape, at least over a fraction of its length.

The core may be curved about at least two axes that are not mutually parallel.

The brush portion may have a stepped cross-section over at least part of its length.

The core may have a nonuniform curvature. For example, the core may comprise a curved portion and a rectilinear portion, the rectilinear portion being attached to the stem.

According to an exemplary embodiment, the device may further comprise a container configured to contain the product to be applied to the keratinous fibers. The device also may comprise a wiper configured to wipe excess product from the brush portion. Further, the device may comprise a handle member attached to an end of the stem opposite the end to which the brush portion is connected.

In yet another aspect, the device may further comprise the product and the container may contain the product. The product may comprise a mascara product. The brush portion may be configured to apply product to eyelashes.

In an exemplary embodiment, the cross-section of the envelope surface may vary in a nonmonotonic manner.

As used herein, the expression "the cross-section of the brush varies in a nonmonotonic manner" means that the cross-section of the brush is not constant over the whole length of the brush and does not vary in a strictly increasing or decreasing manner from one end of the brush to the other. For example, the cross-section may vary in a non-monotonic manner because of the shape of a blank from which the brush is made, such a blank having, for example, a maximum and/or minimum cross-section spaced from each end of the brush, or because of the presence of one or more facets or notches formed in an outer envelope surface of the brush, for example.

An entire length of the core of the brush portion to which the bristles are connected may be curved.

In yet another aspect, the invention may include a method of making an applicator for applying a product to keratinous fibers comprising providing a blank comprising a blank core and bristles connected to the blank core. The bristles may comprise ends defining a blank envelope surface having a varying cross-section over at least a part of its length and being asymmetrical about a midplane of the blank envelope surface. The midplane may be perpendicular to the blank core. The method may further comprise curving at least a part of the blank core so as to form a brush portion comprising a core and a free end not aligned with a longitudinal axis of an end portion of a stem to which the brush portion is adapted to be connected. A line tangent to the core at any axial position along the core may be nonperpendicular to the longitudinal axis of the end portion of the stem when the brush portion is connected to the end portion of the stem.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

The method may further comprise shaving free ends of at least some bristles to form the variable cross-section of the blank envelope surface. The bristles may be configured to apply a product to eyelashes.

The curving of the blank core may comprise curving the blank core in such a manner so as to reduce a curvature of the nonrectilinear edge portion.

The blank envelope surface may have a substantially bullet-like shape, a substantially buoy-like shape, a substantially fish-like shape, a substantially hourglass-like shape, or a substantially football-like shape.

The blank may comprise at least one facet on the blank envelope surface and the method may further comprise forming the at least one facet prior to curving the blank core.

According to an exemplary embodiment, the curving of the blank core may comprise curving the blank core about two axes that are not mutually parallel. Under such circumstances, the axis of the core may no longer entirely be contained in a single plane of curvature. The axes about which the core is curved may extend in directions that are optionally perpendicular, and that optionally intersect.

As used herein, the term "plane of curvature" means a plane that is perpendicular to an axis about which the core of a blank/brush portion is curved and that contains at least the curved portion of the axis of the core. When a core is curved about two or more axes not parallel to one another, the core will have multiple planes of curvature.

The blank core may be rectilinear.

The curving of at least the part of the blank core may comprise curving an entire length of the blank core to which the bristles are connected.

In an exemplary embodiment, the brush may be made from a blank having a rectilinear core, that is not symmetrical about a midplane perpendicular to the core, and has an edge that is not rectilinear when observed in profile in a direction perpendicular to the core, said edge being straightened out at least in part by the curvature imparted to the core during manufacture of the brush.

It also may be possible, for example, to provide the core with maximum curvature in a narrower portion of the blank envelope surface when the blank envelope surface is substantially fish-shaped or hourglass-shaped. This may raise the proximal end portion of the blank envelope surface and may have the effect of further deepening the upwardly concave top edge of the blank while flattening out its downwardly concave and diametrically opposite bottom edge.

In general, the curvature given to the core may have the effect of moving the convex or concave face of the blank envelope surface, e.g., so as to make it substantially rectilinear, and in particular substantially parallel to the axis of the stem. When the curvature given to the core has the effect of straightening a concave or convex face so as to make it substantially rectilinear, this curving can be performed about an axis contained in a midplane for said face.

A brush of the type described above may make it possible to obtain makeup of very satisfactory quality because the core is curved and because, when observed from the side in a direction perpendicular to the axis of the stem, it presents a profile that varies on the brush being turned about the axis of the stem.

For example, the brush may make it possible to take charge of the eyelashes better and it also may enable nonuniform wiping to be obtained, thereby leading to different zones of the brush taking up different amounts of product.

Thus, the user may have both a larger quantity of product available so as to be able to apply product locally to the eyelashes if that should turn out to be desirable during making up the lashes. At the same time, the user may not have to dip the brush back in the container to reload it with product. Further, bristles that carry relatively little product may be used for separating the eyelashes, in particular the small eyelashes at the end of an eyelid.

One exemplary methodology for determining whether a brush portion of the invention has been formed from one of the blanks described above may involve straightening the curved part of the brush portion core so as to place it in a rectilinear configuration and then observing the resulting configuration of the envelope surface as well as the asymmetry about a midplane of the envelope surface oriented perpendicularly to the now rectilinear core. This methodology may provide one exemplary way in which to determine the configuration of the blank that was used to form the brush portion of the final applicator.

The term "curved" as used herein should be understood as "nonrectilinear" and includes both a curved line or a line that is bent at an angle.

"Nonuniform curvature" of the core as used herein means that there may be at least two different points along the core where the radius of curvature (which can be infinite) differs. The core having a nonuniform curvature may have greater curvature closer to its free end than to the end attached to the stem, for example. Alternatively, it can include a rectilinear or substantially rectilinear portion together with a curved portion, which is the case in particular when the core of the brush portion has a rectilinear part fixed to the end portion of the stem and when the bristles are supported by a curved part, the curvature of the curved part itself being either uniform or nonuniform.

The cross-section of the envelope surface of the blank may be of a shape that varies in geometrically similar manner over at least a fraction of the length of the envelope surface, for example, over more than one-third of its length. In other words, if two differently sized cross-sections of the envelope surface taken at two different locations along the length thereof are geometrically similar, then one of those sections is a scale magnification or scale demagnification of the other cross-section (e.g., the cross-sections may be shaped analogous to homothetic figures).

The core can be a twisted core having a left-hand or a right-hand pitch, and in particular a left-hand pitch as described in French patent application FR-A-2 701 198.

In a left-hand pitch brush, the strands of the core are twisted by being turned to the left so as to form turns which, when viewed along the axis of the core from the end which is fixed to the stem, turn clockwise on going away from the stem towards the free end of the brush. In a right-hand pitch brush, the strands of the core are twisted in an opposite manner.

It is also possible to act on the curvature imparted to the core, when the core has a right-hand pitch, so as to orient the bristles in a desired direction.

The core can be made other than by twisting together two strands of a metal wire, for example the bristles could be implanted or molded on a support in the form of a core-like structure.

The bristles may be natural or synthetic, and their ends can be subjected to any known type of treatment, for example to give them rounded tips or forked ends. The brush can have a mixture of bristles. For example, the bristles used can be of any kind, in particular they can be hollow, they can have capillary grooves, they can be flat or cork-screw-shaped, or indeed each of them can have a zone for preferential deformation.

Besides the structural and procedural arrangements set forth above, the invention could include a number of other arrangements, such as those explained hereinafter. It is to be understood that both the foregoing description and the following description are exemplary. The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a side view of an exemplary embodiment of a blank used for making an applicator according to an aspect of the invention;

Figure 33:
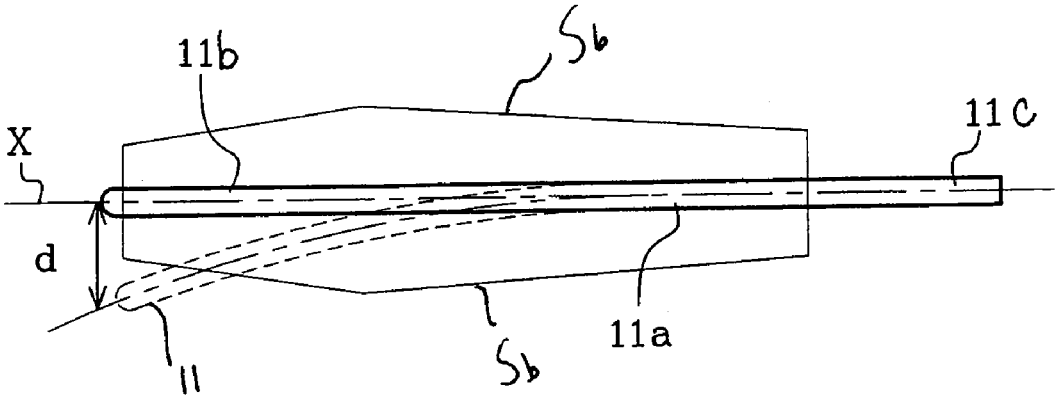
Figure 34:
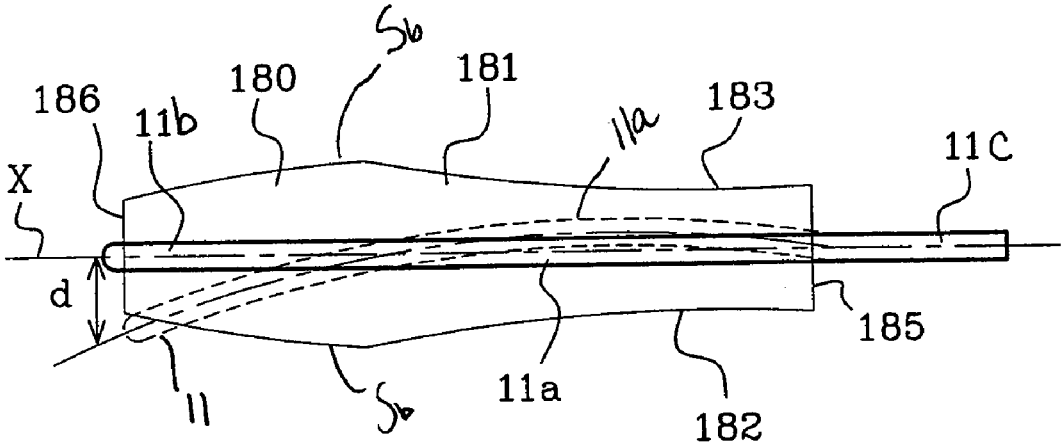

FIG. 33 is a side view of an exemplary embodiment of a blank shown in solid lines and the curvature imparted to the core shown in dotted lines to form an applicator embodiment according to an aspect of the invention; and FIG. 34 is a side view of another exemplary embodiment of a blank shown in solid lines and the curvature imparted to the core shown in dotted lines to form an applicator embodiment according to an aspect of the invention.

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

Figure 5:
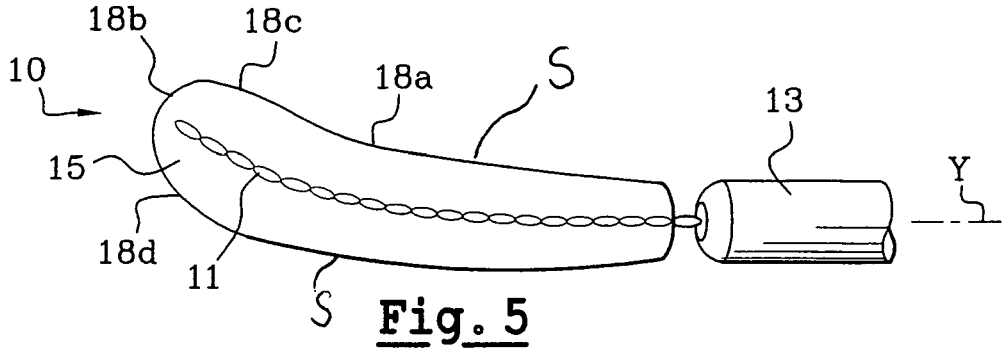
FIG. 5 is a side view of an applicator formed from the blank of FIG. 1.

FIG. 5 shows an exemplary embodiment of an applicator 10. The applicator 10 may comprise a core 11, which may be made by twisting together two strands of metal wire, for example. Bristles (not shown) may be held in conventional manner between the turns of the core 11 so as to form a brush portion of the applicator. For the sake of clarity, FIG. 5 shows only the envelope surface S defined by the free ends of the longest bristles held by core 11.

The core 11 may be fixed at one end to a stem 13 having a longitudinal axis Y. By way of example, the stem 13 may be made of plastic and the core 11 may be inserted as a force-fit into a housing situated at an end portion of the stem 13.

Figure 1:
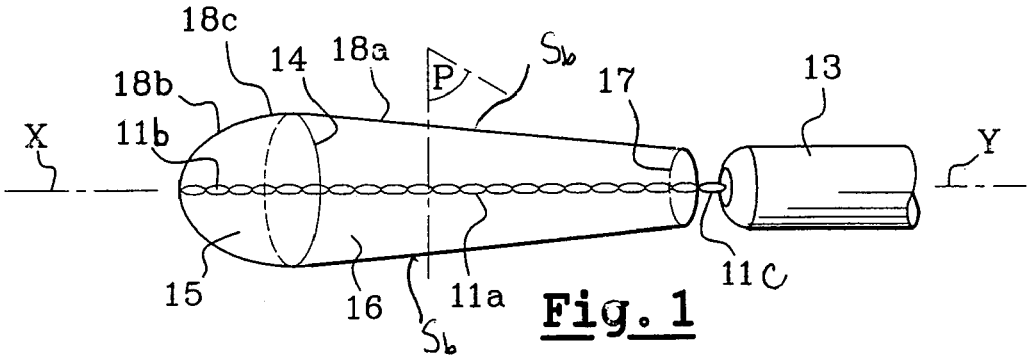

To make the applicator 10, the starting structure may be in the form of a blank, as shown in FIG. 1. In the exemplary embodiment of FIG. 1, the blank comprises a blank core 11*b* and blank bristles connected to the blank core 11*b*. Rather than illustrating these blank bristles individually, the blank envelope surface $S_b$ defined by the free ends of the longest blank bristles is shown. In FIG. 1, this envelope surface $S_b$ is substantially bullet-shaped.

The blank of FIG. 1 also may be substantially circularly symmetrical about the axis X of the blank core 11*b*. Further, the blank core 11*b* may be rectilinear, and the blank envelope surface $S_b$ may be asymmetrical about a midplane P of the blank envelope surface $S_b$ perpendicularly intersecting the blank core 11*b*.

The blank envelope surface $S_b$, as shown in FIG. 1, may have a maximum traverse cross-section defined by a maximum diameter circle 14.

The free end portion (i.e., distal end portion) 15 of the blank envelope surface $S_b$ may be bullet-shaped and the remaining body portion 16 of the blank envelope surface $S_b$ may be frustoconical, with the diameter of the body portion 16 tapering in a direction facing away from the free end portion 15 (i.e., toward the stem 13 as shown in FIG. 1) so as to reach a minimum diameter at an end circle 17 of the blank envelope surface $S_b$.

In the plane of FIG. 1, the top edge of the blank envelope surface $S_b$ may comprise a rectilinear first portion 18*a* extending along the body portion 16 between the circles 14 and 17. The top edge may further comprise a rounded second portion 18*b* defining the top of the free end portion 15 which may be substantially in the form of one-fourth of an ellipse, as in the exemplary embodiment shown. The regions of the edge portions 18*a* and 18*b* in the vicinity of the circle 14 may constitute a non-rectilinear edge 18*c*.

To make the applicator 10, the blank core 11*b* carrying the bristles may be subjected to curving about an axis perpendicular to the plane of FIG. 1, so as to straighten out the edges of free end portion 15 of the blank envelope surface $S_b$, thereby tending to flatten the edge 18*c*. By curving the blank core 11*b* in this manner, the edge 18*c* may become substantially rectilinear and in line with the portion 18*a*, as can be seen in FIG. 5, for example.

The brush portion of the applicator 10 may then not be circularly symmetrical about the axis Y of the stem 13.

The ends of the bristles of the brush portion situated beside the edge 18*c* may be further off-center from the axis Y of the stem 13 as compared to the ends of the bristles on the diametrically opposite side. Thus, after the brush portion of the applicator 10 has been withdrawn from a container containing product and wiped, it may be loaded with a larger quantity of product on its edge 18*d* situated substantially on the axis Y of the stem 13, while being wiped more thoroughly and thereby loaded with less product on its edge 18*c*.This may facilitate product application since a user may be able to apply more product locally to the eyelashes where necessary by taking that product from the region of the brush portion that is wiped less thoroughly. The user also may be able to separate the eyelashes by using the bristles that carry less product.

Figure 32:
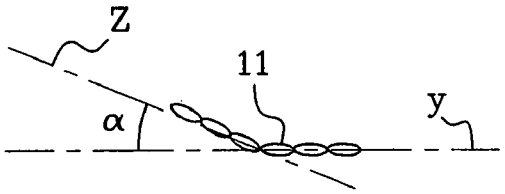
FIG. 32 is a partial view of the core of FIG. 33 showing the angle between the direction of the core and the axis of the stem.

The angle α between a line tangent to the core 11 at any axial position of the core 11 and the axis Y of the stem may be less than 90°, as shown in FIG. 32. In other words, a line tangent to the core 11 at any axial position of the core and the axis Y of the stem may intersect so as not to be perpendicular to one another.

The core 11 may carry bristles only in a fraction of its length or along its entire length up to the stem 13. Thus, the core 11*b* may comprise, as shown in FIG. 1, a portion 11*a* that supports the bristles and that is separated from the stem by a rectilinear portion 11*c* without any bristles. The portion 11*c* may be inserted at least in part in the stem 13. Thus, the core 11*b* may have a nonuniform curvature. Moreover, the curved portion 11*a* may have a uniform curvature or a nonuniform curvature.

Figure 2:
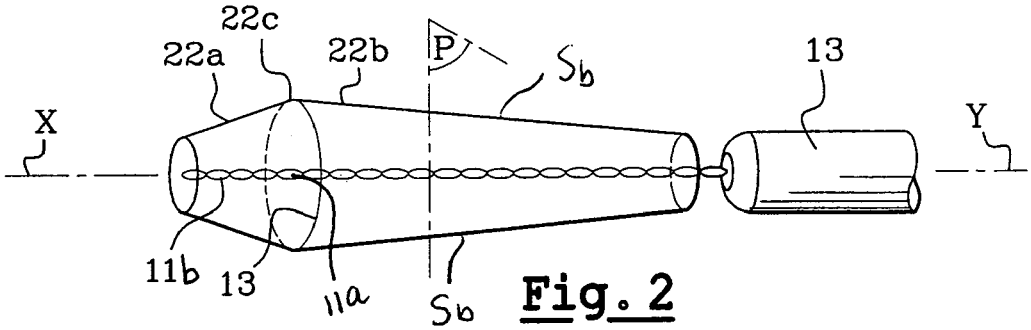
FIG. 2 is a side view of another exemplary embodiment of a blank used for making an applicator according to an aspect of the invention.
Figure 6:
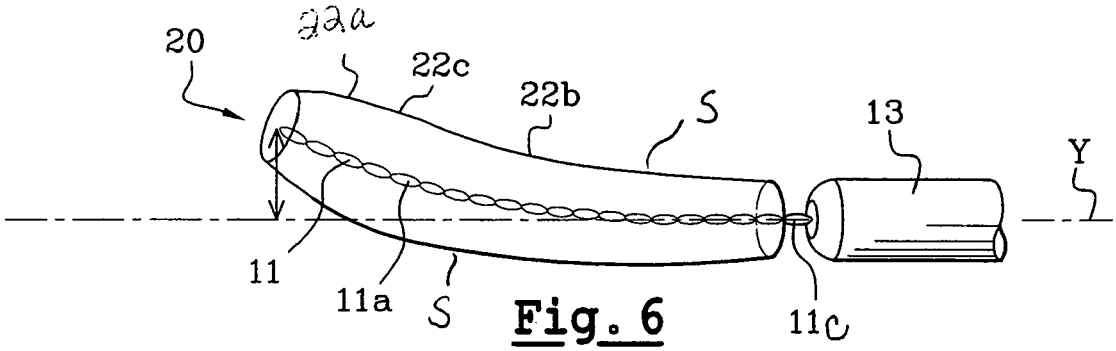
FIG. 6 is a side view of an exemplary embodiment of an applicator formed from the blank of FIG. 2.

FIG. 6 shows an exemplary embodiment of an applicator 20 which is obtained from the blank of FIG. 2. The blank of FIG. 2 may have a blank envelope surface $S_b$ that is substantially buoy-shaped.

The blank envelope surface $S_b$ may be substantially circularly symmetrical about the axis X of the rectilinear core 11*b* and the envelope surface $S_b$ may comprise the combination of two truncated cones joined via their largest faces. The junction of those two faces constituting a maximum diameter circle 13.

The top edge of the FIG. 2 blank envelope surface $S_b$ may be defined by generator lines 22*a* and 22*b* of the truncated cones, and the region in the vicinity of the maximum diameter circle 13 may define a nonrectilinear edge 22*c*. The blank envelope surface $S_b$ of FIG. 2 also may be asymmetrical about a midplane P perpendicularly intersecting the blank core 11*b*.

To make the applicator 20 of FIG. 6 from the blank of FIG. 2, the blank core 11*b* may be curved in such a manner as to bring the portions 22*a* and 22*b* substantially into alignment with each other, thereby also having the effect of increasing the curvature of the diametrically opposite bottom edge, as shown in FIG. 6.

The core 11*b* may be curved, for example, with a substantially constant curvature radius on the portion 11*a* about an axis substantially perpendicular to the plane of FIG. 2 and situated beside the top edge of the blank. The core 11 of the applicator 20 of FIG. 5 presents, in its total length, a nonconstant curvature, the portion 11*c* being rectilinear.

It can be seen in FIG. 6 that the edge 22*c* may become substantially rectilinear by curving the portion 11*a* of the blank core 11*b*.

Figure 3:
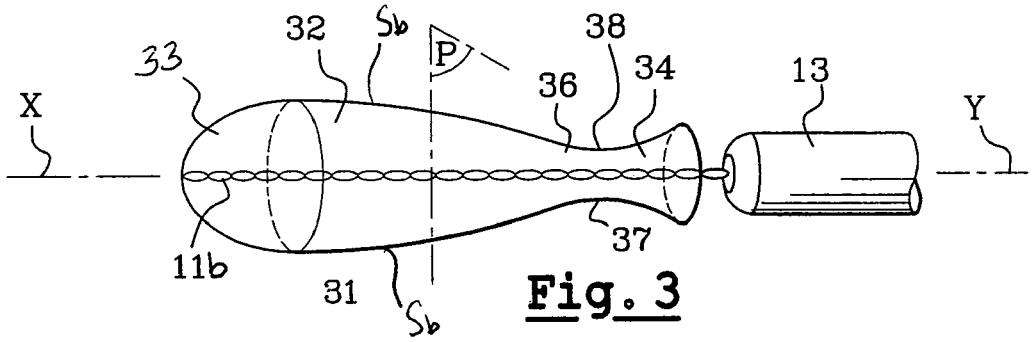
FIG. 3 is a side view of another exemplary embodiment of a blank used for making an applicator according to an aspect of the invention.
Figure 7:
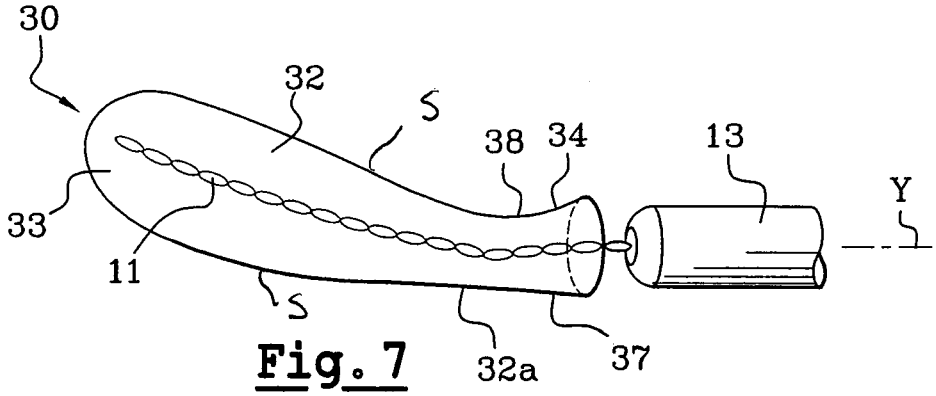
FIG. 7 is a side view of an exemplary embodiment of an applicator formed from the blank of FIG. 3.

FIG. 7 shows another exemplary embodiment of an applicator 30 made from the blank of FIG. 3 having a fish-shaped blank envelope surface $S_b$.

The blank envelope surface $S_b$ may be circularly symmetrical about the axis X of the rectilinear blank core 11*b*, and asymmetrical about a midplane P of the blank envelope surface $S_b$ perpendicularly intersecting the blank core 11.

The blank envelope surface $S_b$ of FIG. 3 comprises a body portion 32 having a maximum cross-section at a maximum diameter circle 31. The free end portion 33 of the blank envelope surface $S_b$ that extends in front of the maximum diameter circle 31 may be substantially bullet-shaped. The proximal end portion 34 of the blank envelope surface $S_b$ may be connected to the body portion 32 via a narrowed portion 36.

The bottom edge 37 of the blank defined by the narrowed brush portion 36 may form a downwardly concave indentation.

To make the applicator 30, the blank core 11*b* of FIG. 3 may be curved to a certain degree so as to flatten its bottom edge 37 and make it less indented, or even rectilinear as in the example shown in FIG. 7. The diametrically opposite top edge 38 of the narrowed brush portion 36 may in turn take on greater curvature because of the way the blank core 11*b* is curved.

The portion 32*a* of the bottom edge of the body portion 32 that is adjacent to the narrow portion 36 of the blank envelope surface $S_b$ also may become straightened because of the curvature given to the blank core 11*b*.

Figure 4:
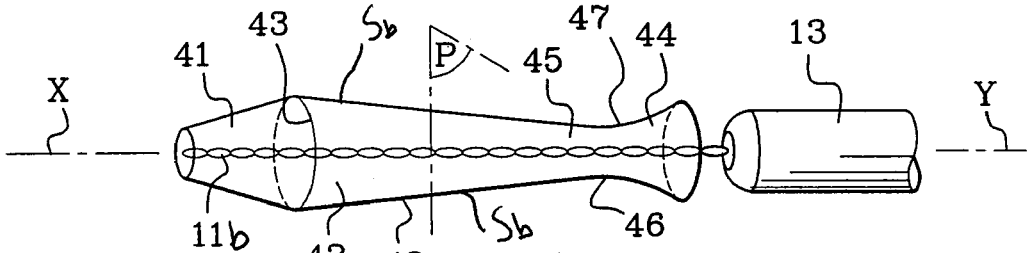
FIG. 4 is a side view of another exemplary embodiment of a blank used for making an applicator according to an aspect of the invention.
Figure 8:
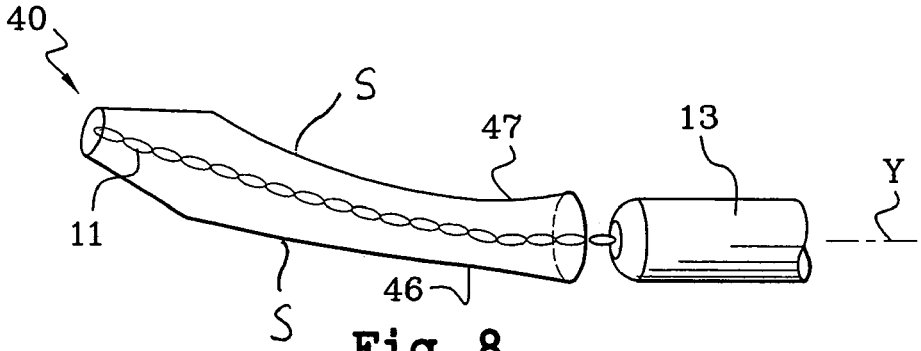
FIG. 8 is a side view of an exemplary embodiment of an applicator formed from the blank of FIG. 4

FIG. 8 shows yet another exemplary embodiment of an applicator 40 obtained from the blank shown in FIG. 4. This blank envelope surface $S_b$ may be substantially fish-shaped and may be substantially circularly symmetrical about the axis X of the rectilinear blank core 11*b*.

The free end portion 41 of the blank envelope surface $S_b$ may be frustoconical in shape. The body portion 42 of the blank envelope surface $S_b$ may be frustoconical in its region adjacent to the maximum diameter circle 43.

The body portion 42 may connect to the proximal end portion 44 of the blank envelope surface $S_b$ via a narrowed portion 45. The bottom edge 46 of the narrowed portion 45 of the blank envelope surface $S_b$ may be downwardly concave.

The FIG. 4 blank may be converted into the applicator 40 by imparting a certain amount of curvature to the blank core 11*b* so as to flatten the bottom edge 46 and cause it to be substantially less indented than it was initially, if not substantially rectilinear and in line with the generator line 42*a* of the body portion 42.

The effect of the curvature given to the blank core 11*b* may be to cause the top edge 47 of the narrowed portion 45 where it is diametrically opposite to the bottom edge 46 to be indented even further.

Each of the blanks shown in FIGS. 1 to 4 may have one or more facets or notches formed in the envelope surfaces prior to curving the core.

Figure 9:
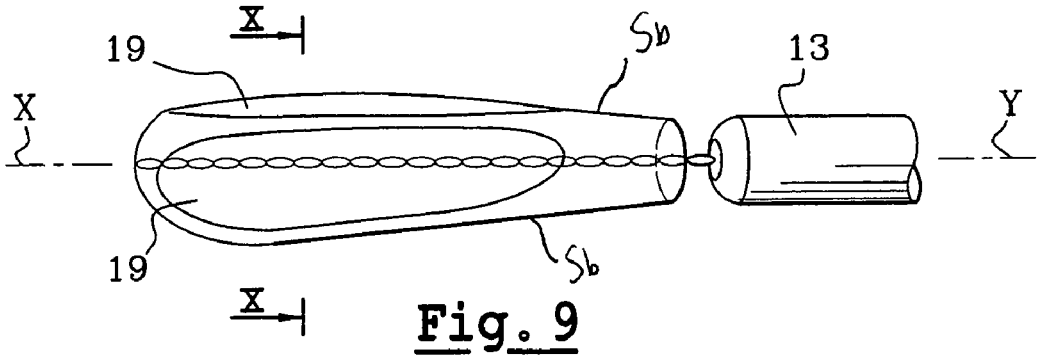
FIG. 9 is a side view of a blank like that of FIG. 1, with facets formed on sides of the brush portion.
Figure 10:
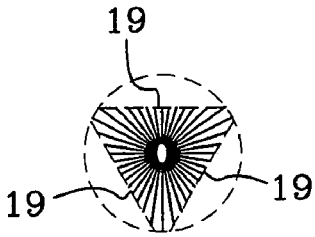
FIG. 10 is a cross-sectional view taken along line X-X of FIG. 9.

By way of example, FIG. 9 shows a blank like the blank of FIG. 1 with an envelope surface $S_b$ having three substantially plane facets 19. This may provide the cross-section of the body portion of the blank envelope surface $S_b$ with a shape that is generally triangular, as shown in FIG. 10.

In the exemplary embodiment of FIG. 9, the facets 19 are substantially plane, and parallel to the axis X of the core.

Figure 10A:
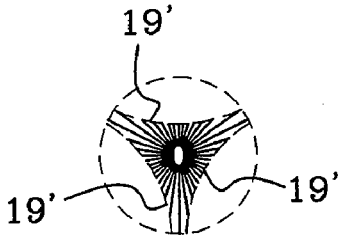
FIG. 10A is a cross-sectional view similar to FIG. 10 showing a variant embodiment of the blank of FIG. 9 with notches.

In a variant, the facets of FIG. 9 could be replaced by notches 19' of outwardly concave cross-section as shown in FIG. 10A, or by notches having a profile that is outwardly concave when the brush is observed in a direction perpendicular to the axis of the stem, the profile of the notch being in the form of a circular arc, for example.

Figure 11:
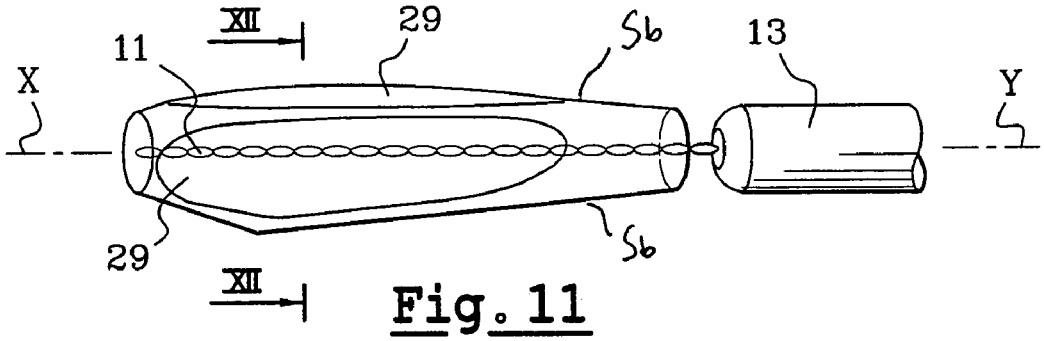
FIG. 11 is a side view of a blank like that of FIG. 2, with facets formed on its sides.
Figure 12:
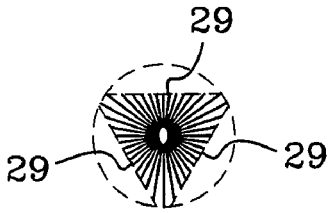
FIG. 12 is a cross-section taken along line XII-XII of FIG. 11.

FIG. 11 shows a blank like that of FIG. 2, with three substantially plane facets 29 formed on an outer surface of the brush portion. This provides the blank envelope surface $S_b$ with a cross-section that is substantially triangular in shape at least over a part of its length.

Figure 13:
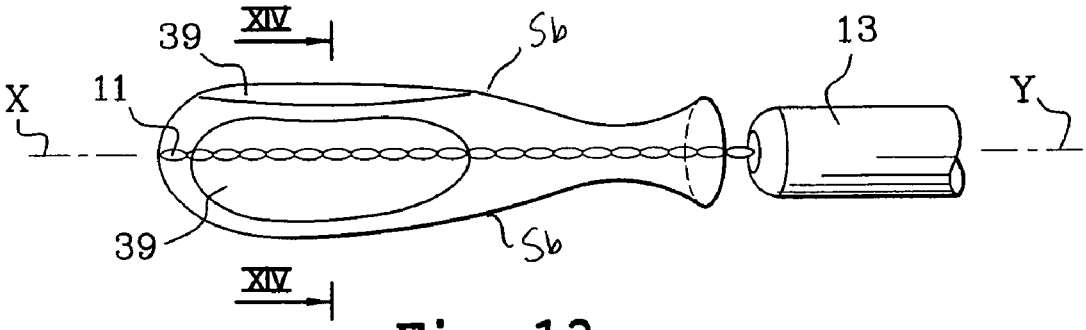
FIG. 13 is a side view of a blank like that of FIG. 3, with facets formed on its sides.
Figure 14:
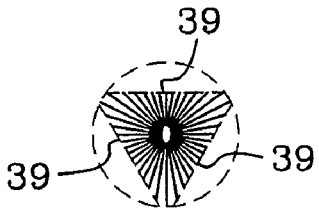
FIG. 14 is a cross-section taken along line XIV-XIV of FIG. 13.

FIG. 13 shows a blank like that of FIG. 3, with three substantially plane facets 39 formed in the blank envelope surface $S_b$. This also may provide the blank envelope surface $S_b$ a cross-section that is generally triangular in shape at least over a part of its length.

Figure 15:
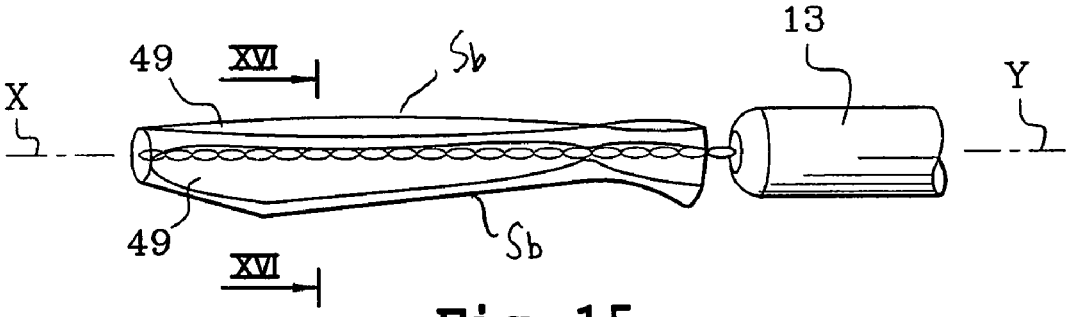
FIG. 15 is a side view of a blank like that of FIG. 4, with facets formed on its sides.
Figure 16:
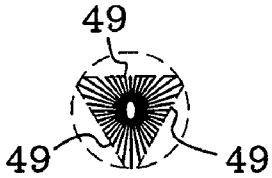
FIG. 16 is a cross-section taken along line XVI-XVI of FIG. 15.
Figure 17:
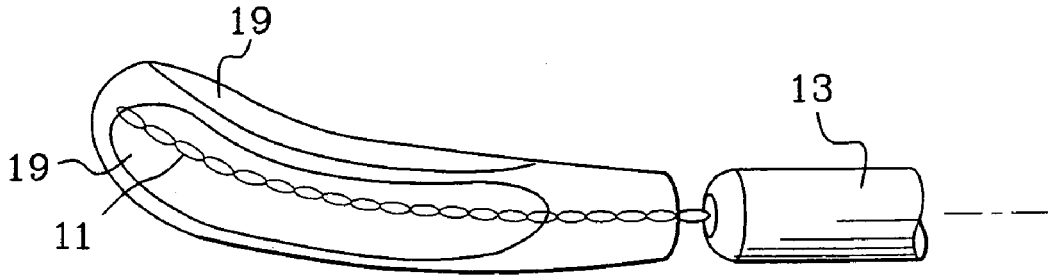
FIG. 17 is a side view of an applicator embodiment formed from the blank of FIG. 9 after the blank core has been curved.
Figure 18:
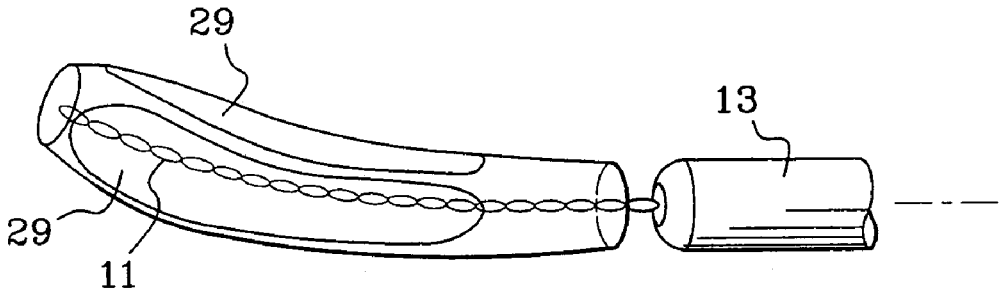
FIG. 18 is a side view of an applicator embodiment formed from the blank of FIG. 11 after the blank core has been curved.
Figure 19:
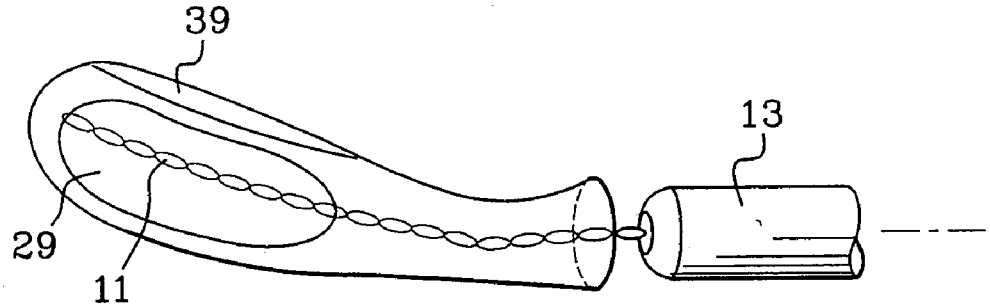
FIG. 19 is a side view of an applicator embodiment formed from the blank of FIG. 13 after the blank core has been curved.
Figure 20:
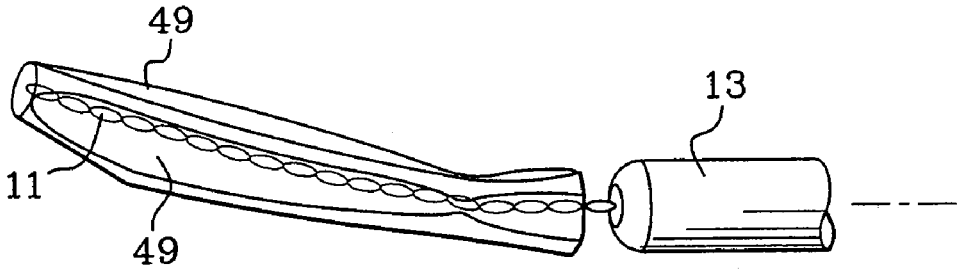
FIG. 20 is a side view of an applicator embodiment formed from the blank of FIG. 15 after the blank core has been curved.

FIG. 15 shows a blank like that of FIG. 4 on which three substantially plane facets 49 have been made. Whereas in the exemplary embodiment of FIG. 13, the facets 39 extend only over the main body portion of the blank envelope surface $S_b$, in the exemplary embodiment of FIG. 15, the facets 49 may extend over the entire length of the blank envelope surface $S_b$, including over its proximal end portion, as shown.

FIGS. 17-20 show the various applicator brushes that may be obtained by subjecting the blanks of FIGS. 9, 11, 13, and 15 respectively to the same transformation as was used to convert the blanks of FIGS. 1 to 4 into the brushes of FIGS. 5 to 8. That is, by curving at least part of the blank core 11*b* of each of the blanks in FIGS. 9, 11, 13, and 15.

In the exemplary embodiments of FIGS. 17 to 20, the plane of curvature of the core 11 may be substantially perpendicular to the respective facet 19, 29, 39, or 49 that is situated diametrically opposite to the nonrectilinear edge that has been straightened out as a result of curving the blank core 11*b*. The plane of curvature of the core 11 also may be a midplane of symmetry for one of the facets.

In one or more of the examples described above, the blank core 11*b* may be curved about a single axis.

Without going beyond the ambit of the present invention, it also may be possible to curve the core about two or more axes, that are optionally parallel, that are optionally perpendicular, or that optionally intersect at any angle.

Figure 21:
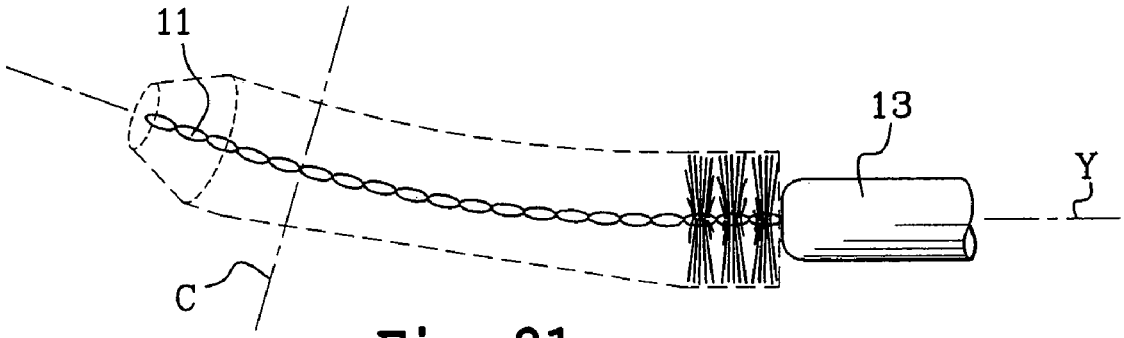
FIG. 21 is a side view of the brush of an applicator embodiment formed by curving the core of the applicator of FIG. 8 a second time.

By way of example, FIG. 21 shows a brush like that of FIG. 8, wherein the core 11 has been curved a second time about a bending axis C parallel to the plane of FIG. 21, i.e. parallel to the plane of curvature of the FIG. 8 brush. Due to this additional curving, the core 11 may no longer lie in a single plane of curvature, which may improve the ergonomics of the brush.

Figure 22:
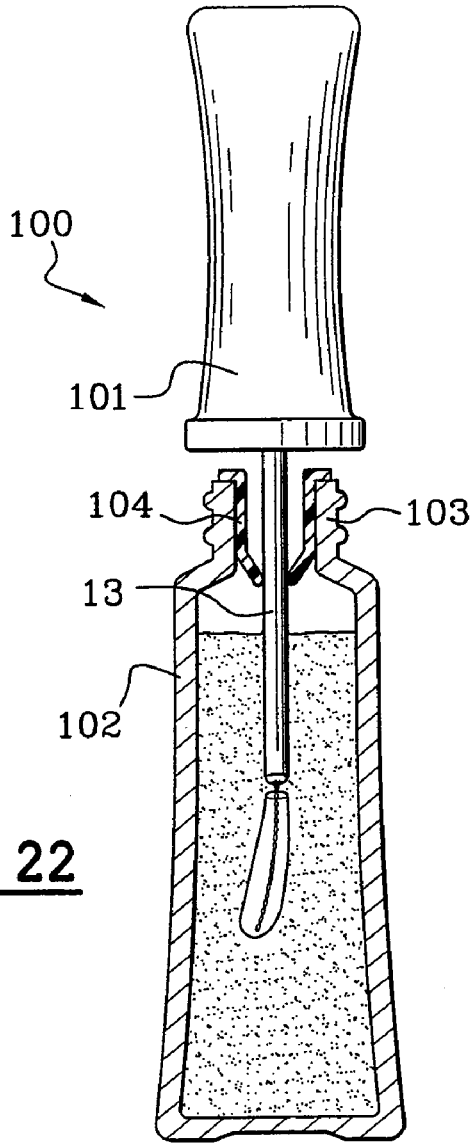
FIG. 22 is a cross-sectional view of a system embodiment including a container and an applicator according to an aspect of the invention.

FIG. 22 shows an exemplary embodiment of an application system 100 that comprises an applicator in accordance with an exemplary embodiment of the invention. The stem 13 of the applicator may be fixed to a cap 101 which may serve both as a handling member and as a substantially leaktight (as to air and/or product) closure of a container 102. The container 102 may contain the product for application, such as a mascara product for application to eyelashes, for example.

The system 100 has a container 102 optionally including a neck portion 103 with an external threading configured to cooperate with internal threading provided on the cap 101. A wiper 104 of any conventional type may be situated near an opening in the container. The wiper 104 may be adapted to wipe the stem 13 and the brush portion of the applicator as the applicator is removed from the container 102.

The brush can have at least one outer applicator surface that is substantially parallel to the stem 13, for example.

Figure 23:
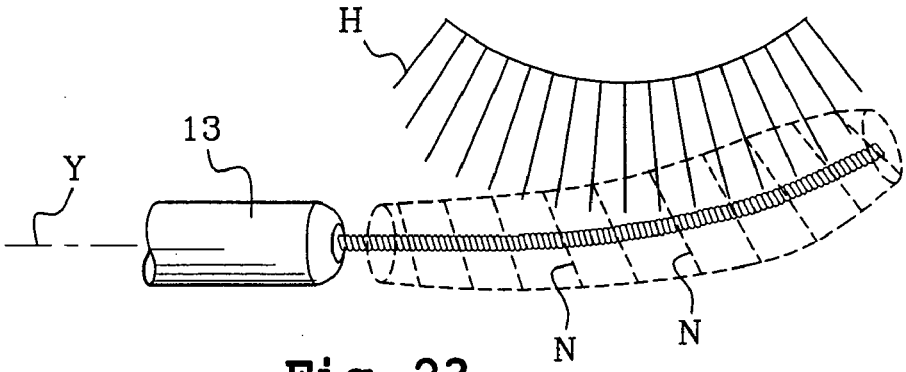
FIG. 23 is a schematic view of the brush of FIG. 6 being used for applying product to the eyelashes.
Figure 24:
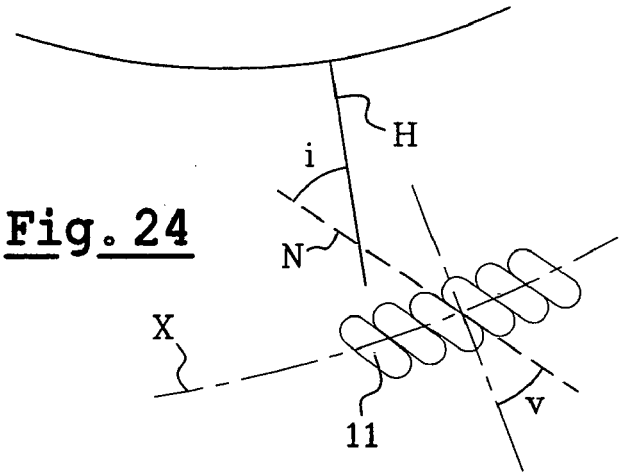
FIG. 24 shows the various angles between a helical sheet, an eyelash, and the axis of the core during application of product to the eyelashes using an exemplary embodiment of an applicator.

It should be noted that it may be desirable to form the brushes described herein from a blank core having a left-hand pitch, as explained below with reference to FIGS. 23 and 24. FIG. 23 shows the FIG. 6 brush with a core formed of two branches twisted together with a left-hand pitch. Dashed lines show the paths followed by the sheets N defined by the ends of the bristles held between the twisted branches. As shown, these sheets N may be at an angle v relative to a plane perpendicular to the core 11.

On examining FIG. 23, it can be seen that the angle of the sheets N relative to the axis Y of the stem 13 may decrease on approaching the free end of the brush portion, thereby making it possible to retain a relatively large angle i between the sheets N and the eyelashes H at the end of the eyelid. This may permit good separation of the eyelashes.

Figure 25:
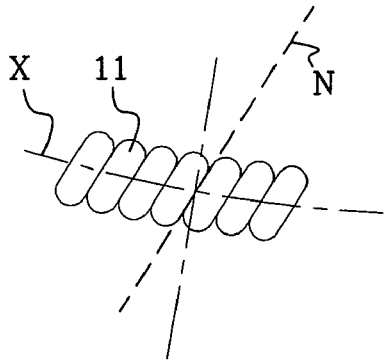
FIG. 25 is a view analogous to FIG. 24, showing a partial view of an exemplary embodiment of a core with a right-hand twist.

Naturally, the invention is not limited to a core with a left-hand pitch and it is also possible to use a core with a right-hand pitch, as shown in part in FIG. 25.

Figure 26:
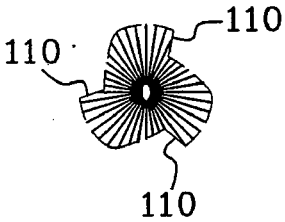
FIG. 26 is a cross-sectional view of an exemplary embodiment of a brush portion having an envelope surface with steps.

In another exemplary embodiment, steps may be made in an envelope surface of the brush portion, as shown in FIG. 26. In this figure, it can be seen that the brush portion has been machined in such a manner as to form setbacks 110 in its envelope surface over at least a fraction of its length. These setbacks may have flanks that are substantially radial, for example.

Figure 27:
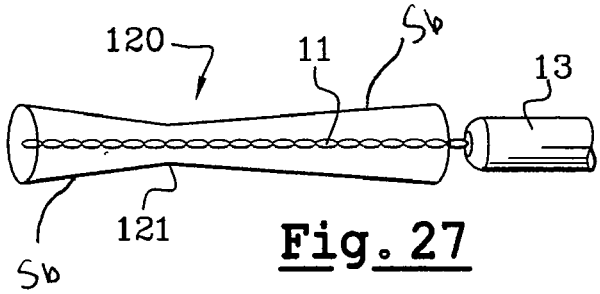
FIG. 27 is a side view of an exemplary embodiment of a blank envelope surface that is generally hourglass-shaped.

FIG. 27 shows an exemplary embodiment of a blank 120 used to form a applicator brush according to an aspect of the invention. As shown, the blank envelope surface $S_b$ may be substantially hourglass-shaped. The blank envelope surface $S_b$, when observed from the side, defines a nonrectilinear edge portion 121 that may be straightened by imparting curvature relatively locally to the blank core 11*b*, for example in the vicinity of the smallest diameter of the blank envelope surface $S_b$.

Figure 28:
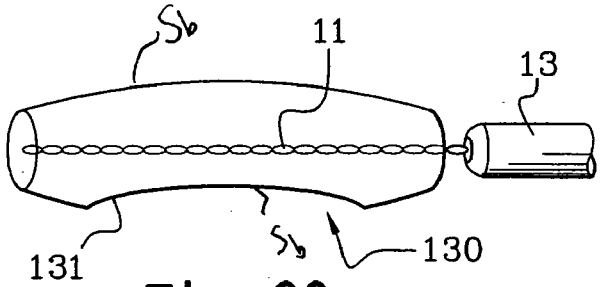
FIG. 28 is a side view of an exemplary embodiment of a blank that is generally football-shaped, including a notch.

FIG. 28 shows another exemplary embodiment of a blank 130 having a blank envelope surface $S_b$ that is substantially football-shaped with a notch-shaped 131 cut-out. This concave notch 131 may be made substantially plane by imparting curvature to the blank core 11*b*.

Figure 29:
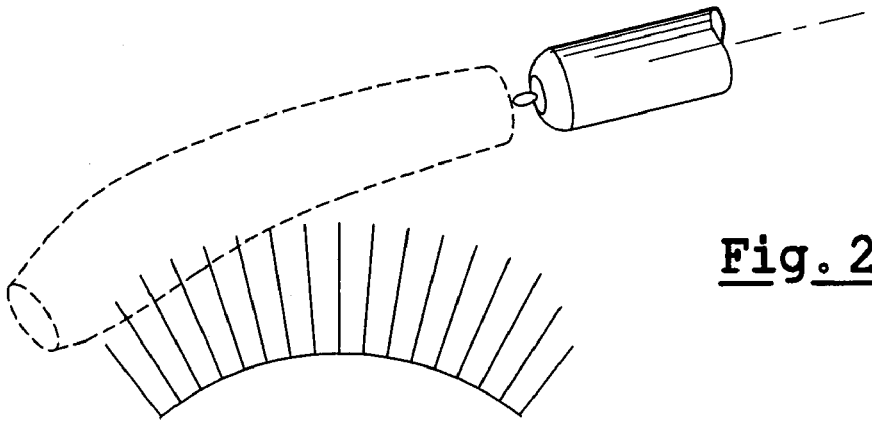
FIG. 29 is a side view of an outline of the applicator of FIG. 6 in use for making up the eyelashes.
Figure 30:
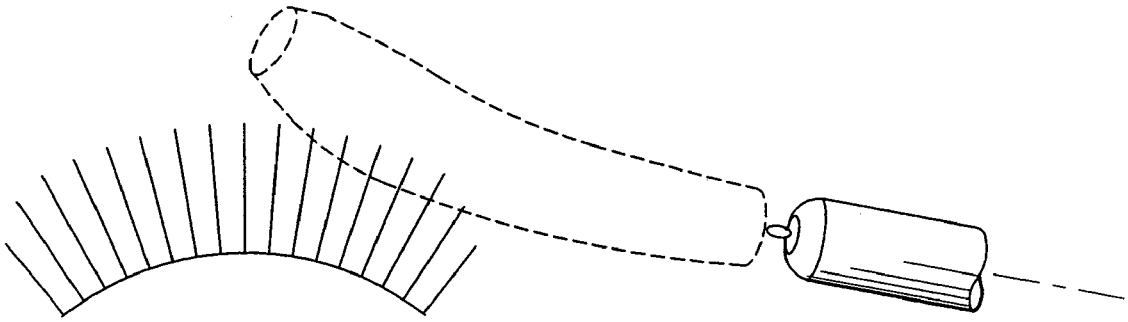
FIG. 30 is a side view of an outline of the applicator of FIG. 6 in use for making up the eyelashes.

FIGS. 29 and 30 schematically illustrate how the FIG. 6 applicator brush may be used for making up the eyelashes. One side of the brush portion can be used for making up eyelashes situated at one end of the eyelid, as shown in FIG. 29, while the opposite side of the brush can be used while making up the eyelashes situated at the opposite end of the eyelid, as shown in FIG. 30.

Figure 31:
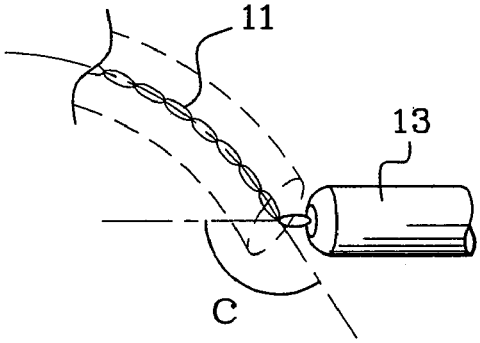
FIG. 31 is a partial side view of an exemplary embodiment of an applicator having an angled bend made in the core close to the end portion of the stem.

The core 11 of a brush as described above can have its curved part located very close to the stem 13, as shown in FIG. 31, thus modifying the handling thereof, if desired.

FIGS. 33 and 34 schematically illustrate two blanks for forming an applicator brush according to exemplary embodiments before a portion 11*a* of the blank core 11*b* has been curved and inserted in a stem. In both examples, the blank core 11*b* is entirely rectilinear before it is fixed to the stem.

The core 11 of the brush portion can also be seen, in both FIGS. 33 and 34, in short dashes. In the example of FIG. 33, the blank envelope surface $S_b$ is substantially bi-frustoconical about the axis X of the blank core 11*b*. The total length of the portion 11*a* that supports the bristles may be, for example, about 26 mm.

The greatest diameter of the blank may be slightly more than 7 mm, for example, and the end diameters may be about 4 mm, for example. The total length of the core 11 may be approximately 35 mm, for example.

The core 11 may be curved along the entire portion 11*a*,and the portion 11*c* may remain substantially rectilinear. The curvature radius of portion 11*a* may be about 60 mm, for example The portion 11*a* of the core 11 may have either a uniform or nonuniform curvature.

The free end of the core 11 may be unaligned with the axis of the rectilinear part 11*c* or with the axis of the stem (not shown) to which the brush is to be connected. The distance d between the free end before and after the core has been curved may be approximately 4.5 mm, for example.

FIG. 34 shows another example of a blank before the blank core 11*b* has been curved. The blank envelope surface $S_b$ has a substantially fish-like shape, with a substantially frustoconical free end (distal end) portion 180 and a circularly-symmetrical portion 181 delimited in longitudinal cross-section by two concave circular longitudinal sections 182 and 183. The radius of curvature of these longitudinal sections 182 and 183 may be approximately 52 mm, for example. The diameter of the blank envelope surface $S_b$ at its ends 185 and 186, may be respectively about 7.5 mm and 5 mm.

The applicator may be made from the FIG. 34 blank by curving the portion 11*a* of the blank core 11*b* supporting the bristles. As shown in FIG. 34 by the dashed lines, the portion 11*a* of the core 11 may have a substantially constant curvature radius over the entire length of the portion 11*a*. There may be a small angle between the end of the portion 11*a* adjacent to the portion 11*c*.

The distance d between the end of the core before and after it has been curved may be about 2 mm to about 4 mm.

In the various figures, the curvature of the core has been exaggerated in order to facilitate understanding.

It would not go beyond the ambit of the present invention for the curvature to be less marked, for example for it to match that of an eyelid.

The core can also be curved into an S-shape in a single plane of curvature.

It will be understood that the invention may permit the making of a brush that is capable of being wiped in non-uniform manner, having a distal end portion that is off-center relative to the axis of the stem to which the brush portion is attached.

A brush of the invention may be particularly ergonomic.

The invention also may make it possible to obtain a brush presenting faces on its envelope surface of differing shapes, which in turn may permit a wide variety of application and/or make-up effects to be obtained with a single applicator.

The various embodiments described above with reference to the figures related to an applicator for applying a product to keratinous fibers, such as mascara to eyelashes for example. However, in its broadest aspects the present invention could be used for the application of many other types of products. Furthermore, sizes of various structural parts and materials used to make these parts are illustrative and exemplary only and one of ordinary skill in the art would recognize that these materials and sizes can be changed as necessary to produce different effects or desired characteristics of the dispensing assembly.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed:

1. A device for applying a product to eyelashes, the device comprising:

a stem having two opposite ends; and a brush portion connected to one end portion of the stem, the one end portion of the stem having a longitudinal axis and the brush portion having a free end that is not aligned with the longitudinal axis of the one end portion of the stem, wherein the brush portion comprises a core having a core free end, at least part of the core being curved such that all lines tangent to the core at any axial position along the core are not perpendicular to the longitudinal axis of the one end portion of the stem and a longitudinal axis of the core free end is not parallel to the longitudinal axis of the one end portion of the stem, and wherein the brush portion further comprises bristles connected to the core, the bristles comprising ends defining an envelope surface having a varying cross-section along at least a part of its length, the envelope surface being asymmetrical about a midplane of the envelope surface, the midplane being oriented perpendicular to the core, the core having a bristle carrying portion having a longitudinal axis extending on a plurality of sides of the longitudinal axis of the end portion of the stem.

2. The device of claim 1, wherein the bristle carrying portion comprises a rectilinear portion and a curved portion.

3. The device of claim 1, wherein the core is curved about at least two axes that are parallel.

4. The device of claim 1, wherein a distance of the free end of the core to the longitudinal axis of the end portion of the stem ranges from 2 mm to 4 mm.

5. The device of claim 1, wherein the bristle carrying portion forms an angle where the bristle carrying portion connects to a rectilinear portion of the core connected to the end portion of the stem and not carrying bristles.

6. The device of claim 1, wherein the brush portion is formed from a blank comprising a rectilinear blank core and blank bristles having ends defining a blank envelope surface, the blank envelope surface being asymmetrical about a midplane of the blank envelope surface oriented perpendicular to the blank core, wherein an edge portion partially defining the blank envelope surface is nonrectilinear when observed in profile in a direction perpendicular to the blank core, and wherein said edge portion becomes at least partially straightened when the blank core is curved from rectilinear to a shape of the core in the brush portion.

7. The device of claim 6, wherein the nonrectilinear edge portion is located in one of a first third and a last third of the length of the blank envelope surface.

8. The device of claim 6, wherein the nonrectilinear edge portion is defined at least in part by one of:

a substantially bullet-shaped part of the blank envelope surface, the substantially bullet-shaped part comprising a free end of the blank, wherein a cross-section of a remainder of the blank envelope surface tapers over at least a part of the length of the blank envelope surface in a direction from the substantially bullet-shaped part toward an end of the blank opposite the free end of the blank, and an intersection of a frustoconical-shaped zone of the blank and a frustoconical-shaped body portion of the blank, the frustoconical-shaped zone being proximate a free end of the blank and converging toward the free end of the blank, and the frustoconical-shaped body portion extending from the intersection and converging toward an end of the blank opposite the free end of the blank.

9. The device of claim 6, wherein the blank envelope surface has one of:

a fish-like shape, wherein the nonrectilinear edge portion is defined by a zone proximate a junction between an end portion of the blank envelope surface opposite a free end of the blank and a remainder of the blank envelope surface, the end portion forming a tail of the fish-like shape, an hourglass-like shape, wherein the nonrectilinear edge portion is defined by a reentrant angle at a junction between two truncated cone shapes forming the hourglass-like shape, and a football-like shape including at least one cut-out chosen from a notch and a facet, and also including the nonrectilinear edge portion either:

defined by the cut-out, or lying in a vicinity of an end of the cut-out.

10. The device of claim 1, wherein the envelope surface has at least one extreme cross-section chosen from a maximum cross-section and a minimum cross-section located axially between axial ends of the envelope surface.

11. The device of claim 10, wherein the brush portion has a maximum cross-section located axially between axial ends of the envelope surface.

12. The device of claim 1, wherein the longitudinal axis of the bristle carrying portion is of non-uniform curvature.

13. A method of making an applicator for applying a product to eyelashes, the method comprising:

providing a blank comprising a rectilinear blank core and bristles connected to the blank core, the bristles comprising ends defining a blank envelope surface having a varying cross-section over at least a part of its length and being asymmetrical about a midplane of the blank envelope surface, the midplane being perpendicular to the blank core; and curving at least a part of the blank core so as to form a brush portion comprising a brush portion free end not aligned with a longitudinal axis of an end portion of a stem to which the brush portion is adapted to be connected, wherein all lines tangent to the core at any axial position along the core are not perpendicular to the longitudinal axis of the end portion of the stem and a longitudinal axis of the core free end is not parallel to the longitudinal axis of the end portion when the brush portion is connected to the end portion of the stem, wherein the blank envelope surface, when observed in profile from a direction substantially perpendicular to the blank core, has a nonrectilinear edge portion over at least a part of its length, wherein the curving of the blank core comprises curving the blank core in such a manner so as to straighten the nonrectilinear edge portion, and wherein the curving of the blank core leads to:

a core having a longitudinal axis extending on a plurality of sides of the longitudinal axis of the end portion of the stem.

14. The method of claim 13, wherein the cross-section of the blank envelope surface varies in a non-monotonic manner.

15. The method of claim 13, wherein the blank envelope surface is substantially circularly symmetrical.

16. The method of claim 13, wherein the blank envelope surface has one of:

a substantially bullet-like shape, a substantially buoy-like shape, a substantially fish-like shape, a substantially hourglass-like shape, and a substantially football-like shape.

17. The method of claim 16, wherein the blank envelope surface has a substantially fish-like shape, with a substantially frustoconical distal portion and a circularly symmetrical portion delimited in longitudinal cross-section by two concave circular longitudinal sections.

18. The method of claim 13, wherein the curving of at least the part of the blank core comprises curving an entire length of the blank core to which the bristles are connected.

19. The method of claim 13, wherein the curving of the blank core leads to a non-uniform curvature of a bristle carrying portion of the core.

* * * * *